US009352340B2

(12) United States Patent
Bourrilhon et al.

(10) Patent No.: US 9,352,340 B2
(45) Date of Patent: May 31, 2016

(54) DEVICE FOR EJECTING A DIPHASIC MIXTURE

(75) Inventors: Thibaut Bourrilhon, Aix les Bains (FR); Bernard Dusser, Saint Martin de Nigelles (FR); Patrick Fernandes, St. Aubin (FR); Jean-Paul Thibault, Bernin (FR)

(73) Assignees: SIEMENS S.A.S., Saint-Denis (FR); UNIVERSITE GRENOBLE ALPES, Saint Martin (FR); CENTRE NATIONAL DE LA RECHERCHE SCIENTIFIQUE(CNRS), Paris (FR)

( * ) Notice: Subject to any disclaimer, the term of this patent is extended or adjusted under 35 U.S.C. 154(b) by 1544 days.

(21) Appl. No.: 12/444,432

(22) PCT Filed: Aug. 27, 2007

(86) PCT No.: PCT/EP2007/007488

§ 371 (c)(1),
(2), (4) Date: Apr. 6, 2009

(87) PCT Pub. No.: WO2008/040418

PCT Pub. Date: Apr. 10, 2008

(65) Prior Publication Data

US 2010/0006670 A1 Jan. 14, 2010

(30) Foreign Application Priority Data

Oct. 4, 2006 (EP) ..... 06291557

(51) Int. Cl.
*A62C 31/02* (2006.01)
*B05B 1/00* (2006.01)
(Continued)

(52) U.S. Cl.
CPC ..... *B05B 7/0012* (2013.01); *A62C 31/05* (2013.01); *A62C 99/0072* (2013.01);
(Continued)

(58) Field of Classification Search
CPC .. B05B 3/0422; B05B 3/0427; B05B 7/0408; B05B 7/0416; B05B 7/0483
USPC ..... 239/240, 243, 263, 398, 225.1–265, 239/548, 8, 311, 366, 368, 369, 594, 595; 169/14, 37, 44
See application file for complete search history.

(56) References Cited

U.S. PATENT DOCUMENTS 1,484,684 A * 2/1924 Todd et al. ..... 239/233
2,175,160 A * 10/1939 Zobel et al. ..... 239/589
(Continued)

FOREIGN PATENT DOCUMENTS

CA 2131109 A1 3/1996
EP 0608140 A2 7/1994
(Continued)

*Primary Examiner* — Len Tran
*Assistant Examiner* — Alexander Valvis
(74) *Attorney, Agent, or Firm* — Laurence Greenberg; Werner Stemer; Ralph Locher

(57) ABSTRACT

A device for ejecting an at least diphasic mixture includes an injection inlet for a liquid and a gas, a distribution chamber for producing a first liquid-gas mixture, an ejection nozzle of the first liquid-gas mixture in a main direction defined by an axis-vector. The ejection nozzle has a geometry comprising, on its length at least, a minimal section or neck at a location of the axis-vector. Among others things, due to the nozzle geometry, the expansion obtained inside the ejection nozzle allows the first liquid-gas mixture from the distribution chamber to be converted into a second mixture, according to the flow configuration, consisting for instance of a diphasic mist jet having an ejection range and liquid particle size that can be controlled according to the liquid and gas mass flow and to the absolute pressure at the injection inlet.

21 Claims, 2 Drawing Sheets

(51) Int. Cl.

| | |
|---|---|
| ***F23D 11/38*** | (2006.01) |
| ***F23D 14/48*** | (2006.01) |
| ***B05B 7/00*** | (2006.01) |
| ***B05B 7/04*** | (2006.01) |
| ***A62C 31/05*** | (2006.01) |
| ***A62C 99/00*** | (2010.01) |
| ***B05B 3/04*** | (2006.01) |
| ***B05B 3/06*** | (2006.01) |
| *C21C 5/46* | (2006.01) |

(52) U.S. Cl.

CPC ..... *B05B 3/0422* (2013.01); *B05B 3/06* (2013.01); *B05B 7/0025* (2013.01); *B05B 7/0416* (2013.01); *B05B 7/0475* (2013.01); *B05B 7/0483* (2013.01); *C21C 5/4606* (2013.01)

(56) References Cited

U.S. PATENT DOCUMENTS

| | | | | | |
|---|---|---|---|---|---|
| 2,583,726 | A | * | 1/1952 | Chalom | 451/36 |
| 2,678,845 | A | * | 5/1954 | Fitter | 239/248 |
| 2,970,771 | A | * | 2/1961 | Przystawik | 239/17 |
| 3,302,882 | A | * | 2/1967 | Hutton | 239/132.3 |
| 3,428,131 | A | * | 2/1969 | Winslow | 169/15 |
| 3,430,939 | A | * | 3/1969 | Berry | 239/132.3 |
| 3,743,814 | A | * | 7/1973 | Oakes | 219/76.11 |
| 4,052,005 | A | * | 10/1977 | Rymarchyk, Jr. | 239/132.3 |
| 4,301,969 | A | * | 11/1981 | Sharp | 239/132.3 |
| 4,715,538 | A | * | 12/1987 | Lingnau | 239/248 |
| 4,815,665 | A | * | 3/1989 | Haruch | 239/432 |
| 4,919,853 | A | * | 4/1990 | Alvarez et al. | 264/12 |
| 4,951,928 | A | * | 8/1990 | Eysn et al. | 266/225 |
| 5,014,790 | A | * | 5/1991 | Papavergos | 169/44 |
| 5,169,069 | A | * | 12/1992 | Rucker et al. | 239/227 |
| 5,495,893 | A | * | 3/1996 | Roberts et al. | 169/37 |
| 5,575,341 | A | * | 11/1996 | Baker et al. | 169/70 |
| 5,597,044 | A | * | 1/1997 | Roberts et al. | 169/46 |
| 5,706,842 | A | * | 1/1998 | Caimi et al. | 134/113 |
| 6,149,733 | A | * | 11/2000 | Djumlija et al. | 134/32 |
| 6,241,164 | B1 | * | 6/2001 | Wolfe | 239/303 |
| 6,315,221 | B1 | * | 11/2001 | Goenka et al. | 239/589 |
| 6,478,240 | B1 | * | 11/2002 | Dorkin et al. | 239/433 |
| 6,598,802 | B2 | * | 7/2003 | Wolfe | 239/8 |
| 6,599,464 | B1 | * | 7/2003 | Feldhaus | 266/87 |
| 6,988,676 | B2 | * | 1/2006 | Schreur et al. | 239/380 |
| 6,991,362 | B1 | * | 1/2006 | Seaman | 366/168.2 |
| 7,059,543 | B2 | * | 6/2006 | Dushkin et al. | 239/390 |
| 7,131,598 | B2 | * | 11/2006 | Ratnik | 239/14.2 |
| 7,198,456 | B2 | * | 4/2007 | Kolle et al. | 415/82 |
| 7,311,004 | B2 | * | 12/2007 | Giles | 73/592 |
| 7,641,132 | B2 | * | 1/2010 | Richards | 239/349 |
| 7,841,419 | B2 | * | 11/2010 | Manthey et al. | 169/44 |
| 7,878,419 | B2 | * | 2/2011 | Waddelow | 239/104 |
| 8,079,532 | B2 | * | 12/2011 | Baird | 239/240 |
| 8,133,328 | B2 | * | 3/2012 | Delaney et al. | 134/167 R |
| 2005/0006493 | A1 | * | 1/2005 | Stofner | 239/14.1 |
| 2005/0011652 | A1 | * | 1/2005 | Hua | 169/37 |
| 2006/0027679 | A1 | * | 2/2006 | Gratteau | 239/291 |
| 2006/0038044 | A1 | * | 2/2006 | Van Steenkiste et al. | 239/594 |

FOREIGN PATENT DOCUMENTS

| | | | |
|---|---|---|---|
| EP | 1072320 | A1 | 1/2001 |
| EP | 1629899 | A1 | 3/2006 |
| FR | 2548052 | A1 | 1/1985 |
| FR | 2766108 | A1 | 1/1999 |
| JP | 2002336370 | A | 11/2002 |
| WO | 9005000 | A1 | 5/1990 |
| WO | 9530452 | A1 | 11/1995 |
| WO | 0012177 | A1 | 3/2000 |
| WO | 02076624 | A1 | 10/2002 |
| WO | 03041805 | A2 | 5/2003 |

* cited by examiner

DEVICE FOR EJECTING A DIPHASIC MIXTURE

BACKGROUND OF THE INVENTION

Field of the Invention

The present invention relates to a device for ejecting an at least diphasic mixture, comprising at least one injection inlet for a liquid and a gas, a distribution chamber for producing a first liquid/gas mixture, and an ejection nozzle for the first liquid/gas mixture in a main direction defined by a vector axis, together with various advantageous uses of this device according to.

A basic means known for effectively fighting fires is the fire hose, which allows a fire to be "drowned", in particular over a large ejection range but at the cost of an elevated water flow rate.

Another ejection device uses a diphasic mixture, for example by means of inter alia water and pressurized gas, and is used in the field of fire extinguishing to create a water mist or extinguishing foam, such as a conventional extinguisher. The quantity of water required is therefore reduced. Other agents may also be included in the water/pressurized gas phase, such as an emulsifier or another agent of a not necessarily emulsifying nature, such as carbon dioxide. However, addition of an agent remains troublesome, for example due to the limited storage capacity of an extinguisher. The range of conventional extinguishers is furthermore also limited because they are designed for extinguishing small scale fires.

Other systems, for example suitable for long range fire hoses, use a high pressure gas such as nitrogen which allows atomization of water, which must however be pretreated (demineralized). The specific properties of the injected liquid remain a restrictive factor. Consequently, seawater or any other water comprising impurities make it impossible to form a proper diphasic mixture which, quite apart from the elevated gas pressure, does not have a long range.

An attempt has been made to overcome this drawback by using a device for generating diphasic flow, as described in French patent FR 2,548,052. A device of this type comprises a wall defining a chamber where this diphasic flow is produced under pressure, perforated by at least one opening through which there enters a gas under a pressure referred to as "feed pressure", equipped with a first, upstream end connected to a feed source of liquid substantially at the same pressure, together with a second, downstream end connected to a fluid-accelerating nozzle where said fluid undergoes pressure reduction and from which it escapes as a high velocity jet. Such a device makes it possible to create a diphasic jet of water and a non-combustible gas at the very places where the fire is being fought from existing water resources and a source of non-combustible gas. Experience has shown that such devices perform satisfactorily provided that the feed pressure is sufficiently low. They then allow a fire to be extinguished with an effectiveness comparable to that of a foam extinguisher, thus with a restricted range of the jet of diphasic mixture. However, if feed pressure is increased in order to obtain jets of velocities such that they can reach fires at a large distance, the devices cease to operate correctly.

Against this background, a novel device was developed, such as that described in patent application FR 2,766,108, in order to generate diphasic flow, the quality of operation of which is substantially constant whatever the device's (liquid and gas) inlet pressure. This device for ejecting a diphasic mixture comprises two separate inlets, one the liquid injection inlet and one the gas injection inlet, an emulsification chamber to produce a liquid/gas mixture and an ejection nozzle for the first liquid/gas mixture in a main direction defined by a vector axis. In particular, the gas is injected perpendicularly into the water inlet duct through perforated elements which promote emulsification of the liquid/gas mixture. Furthermore, subdividing elements such as blades are arranged parallel to the flow of the water duct so as to form separate flow channels. These blades may be spaced angularly over a section of the water duct surrounded by the perforated elements for gas inlet into the channels. Admittedly, this device does make it possible to generate a constant diphasic jet at various pressures, but it may be subject to disruption due to untimely obstructions at the level of the blades or perforated elements, for example if impurities (sand, pebbles, dirt etc.) are introduced via the water duct or the gas duct. This may also result in transient or extended degeneration of the diphasic mixture, so making fire extinguishing less controllable. Furthermore, the elements arranged internally in the ducts entail complex manufacturing and maintenance procedures.

BRIEF SUMMARY OF THE INVENTION

One aim of the present invention is to propose a simple device for ejecting an at least diphasic mixture which at least enables precise control of its ejection range in a reliably diphasic form.

In particular, this device should adjust to differing liquid and gas injection pressures, which even extend into the low pressure range, while still achieving a long range of the diphasic jet.

The device should be able to manage without complex internal elements which are liable to blockage and remain insensitive to inlet impurities in that the diphasic mixture discharged from the device is provided permanently over the entire length of the jet.

The invention thus proposes a solution based on a device for ejecting an at least diphasic mixture, comprising at least one injection inlet for a liquid and a gas, an emulsification chamber for producing a first liquid/gas mixture, a nozzle for ejecting the first liquid/gas mixture in a main direction defined by a vector axis.

Since the ejection nozzle has a geometry comprising, at least over its length, a minimum cross-section, or neck, at a location along the vector axis, not only is a pressure reduction effect created within the nozzle, as is known in any kind of flow of the Venturi type, but it should also be noted that the geometry of the nozzle is adjusted such that pressure reduction is brought about within the ejection nozzle in such a manner that the first liquid/gas mixture originating from the emulsification chamber can be converted, in the direction of the flow configuration, into a second liquid/gas mixture at the nozzle outlet, the ejection range of said second mixture and the particle size of the liquid in droplet form being controllable as a function of the mass flow rates of the liquid and the gas and of the absolute pressure at the injection inlet.

It should be noted that the invention makes it possible optionally to use a common inlet for the liquid and the gas, which favorably reduces complexity relative to devices with two distinct inlets, whose relative position has to be taken into account in particular when it comes to emulsification.

Furthermore, the invention does not require use of subdividing or perforating elements in one of the injection inlets to allow high-quality emulsification and diphasic mixing, since the geometry of the nozzle associated with generating conditions at the inlet of the device (mass flow rates of the liquid and the gas and absolute pressure at the injection inlet) ensure optimum emulsification and additionally allow the diphasic mixture at the nozzle inlet to be transformed, in the direction of the flow configuration, into a second diphasic mixture at the nozzle outlet whose particle size and range are clearly associated with the generating conditions and therefore controlled. Thus, the device is greatly simplified and additionally any blocking action due to the absence of elements arranged in the complete flow path. Of course, such elements (perforated cone, grid, stirrer, etc.) may be arranged upstream or downstream of the nozzle if the emulsification or configuration of the jet need to be modified.

The geometry of the nozzle is therefore adjusted such that the ejected mixture, designated second mixture to distinguish it from the first mixture on inlet into the nozzle, forms a mist jet mainly following the vector axis of the nozzle and whose particle size, range and volume spread outside the vector axis (also commonly known as jet divergence) are controllable and ensured up to the desired attack surface of the fire.

Due to the cross-sectional geometry of the nozzle of the order of an aperture of one or more millimeters, impurities or even grains of sand, for example, do not cause any appreciable disruption at the level of the ejected diphasic mixture. It is even possible to add an abrasive product, for instance composed of fine solid particles, to the water/gas mixture.

An example of a suitable geometry of a nozzle (or of a multi-nozzle device), in particular at the level of its inlet, its narrowing and its outlet will be illustrated below. The nozzle inlet principally consists of a first converging access zone with a steep gradient followed by a second converging zone with a shallow gradient, a portion with the minimum cross-section, also known as the neck of the nozzle, and optionally a third divergent zone ending in the outlet cross-section of the nozzle. It is thanks to such a configuration or to similar configurations that pressure reduction within the nozzle makes it possible to control the particle size of the jet of mist and its range, as a function of generating conditions which are straightforwardly definable at the device inlet.

In reality, advanced nozzle geometry simulations were carried out to arrive at not only the above example, but also other variations enabling control adjusted to a desired operating mode, for example to enable provision of a variable range while still tending to maintain a controlled particle size of the mist jet.

One major advantage of the invention is that the device may be used at a low absolute pressure (generally of the order of 5 to 10 bar) at the inlet into the emulsification chamber or the nozzle. Within this pressure range, a mist jet flow rate at the nozzle outlet is nevertheless entirely ensured within a range from 50 to 150 m/s and a droplet particle size of 50 to 150 μm. The device thus does not require an elevated inlet pressure or at least a considerable increase, in order to guarantee a longer jet range, such as for a fire at a large distance away. In this way, even in the event of a considerable variation in the range of the jet, untimely and abrupt variations in its particle size (and therefore in its diphasic nature) are avoided.

In summary, the geometry (having at least two sections with a variable diameter along the vector axis at the inlet and at the outlet) of the nozzle according to the invention is capable of ensuring a pressure reduction rate at the nozzle outlet which provides:

- a controlled particle size of the diphasic mixture by breaking the liquid up into droplets
- acceleration and vectorization of the liquid droplets by pressure reduction of the gas likewise pre-emulsified on inlet into the nozzle.

In other words, the geometry of the nozzle makes it possible to impart to a liquid/gas emulsion at the inlet thereto a uniformity of particle size and a controlled range (and vice-versa). It might thus be understood that, in order to vary the resultant range without changing the particle size of the jet and the generating conditions, it would be necessary to modify the geometry of the nozzle, which would be impossible in practice. Indeed, the geometry of the nozzle has been calculated and adjusted to permit a variation in jet range with a constant particle size factor by simply varying one or more of the generating conditions at the inlet or in the device. For simplicity's sake, the inlet pressure (liquid/gas injection) of the device may for example be adjusted by a simple valve.

The invention also has a second advantageous aspect combining a plurality of nozzles as described above and arranged on a rotary carrier, which makes it possible, in addition to a rotary action thanks to the pressure reduction of the nozzles and their particular arrangements on the rotor and relative to one another, to sweep across target surfaces in a complete and extensive manner or alternatively to discharge jets of mist over a large space without for example attempting to hit one specific zone of flame. In the same manner as for control of the range and the particle size of the jet, the speed of rotation may also be favorably controlled for a desired operating mode, as a function of the generating conditions of the multi-nozzle device, which are similar to those of a single nozzle.

Accordingly, the ejection device according to the invention meets particle size control requirements which are of practical importance. This is because the size of the droplets must be adjusted depending on the nature of the seat of the fire, for example by means of finer drops for attacking hydrocarbon fire seats or cooling very hot environments, or by means of larger drops for damping down smoldering fires.

Advantageously, there are various possible uses of the nozzle or of a multi-nozzle device (whether rotary or not), the following being mentioned by way of non-limiting example:

- use for extinguishing a fire, for preventing fire by moistening with low liquid consumption or cooling a material using water possibly containing an extinguishing agent or a wetting agent as the liquid.
- use for surface treatment of a material, such as:
  - for cleaning a material, the liquid being water and/or possibly containing a cleaning agent;
  - for applying paint onto the material where the liquid mainly contains a coloring agent;
  - for abrasive treatment of the material where the second mixture contains a chemical solution which is liquid or partially solid with a small particle size.
- use as a (liquid or gaseous) fuel ejection device.
- use as a propulsion device for an element comprising the nozzle as propulsion means.
- etc.

A set of subclaims also sets out some advantages of the invention.

Examples of embodiment and application are provided with reference to figures in which:

DESCRIPTION OF THE INVENTION

Figure 1:
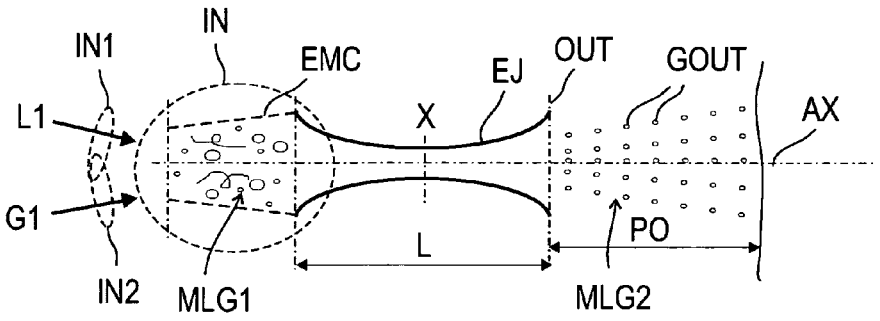
FIG. 1 shows a general description of a nozzle for a diphasic mixture.

FIG. 1 describes in general terms an example nozzle EJ for a diphasic mixture MLG1 produced by means of an emulsification chamber EMC with optional elements or shapes designed to promote mixing of a liquid L1 with a gas G1, both injected at low pressure (less than 20 bar, in practice between 5 and 10 bar). A more precise profile of a suitable nozzle will be described below in this document. The liquid L1 and the gas G1 passing into the emulsification chamber EMC or directly into the nozzle EJ may be directed by two separate channels IN1, IN2 which converge towards the inlet IN. Advantageously, these channels do not need to have a specific arrangement like in the majority of prior art diphasic nozzle devices. Thus, in the emulsification chamber EMC or more generally downstream of the inlet of the nozzle EJ, the first diphasic mixture MLG1 is formed in a manner which is still not ideally controlled, in that the particle size of the mixture MLG1 or the liquid L1 and the flow of the gas G1 are still coarse and very variable. Thanks to the appropriate geometry of the nozzle EJ of length L with a nozzle neck provided at a location X (which may equally well be localized or extended), the first mixture MLG1 is optimally converted by means of pressure reduction over the length of the nozzle into a second diphasic mixture MLG2. The mixture then has a controlled particle size, in other words the liquid L1 provided in the first mixture MLG1 takes the form in mixture MLG2 of droplets GOUT of small diameter (50 to 150 μm) arising from the atomization brought about within the nozzle. The particle size of liquid L1 and therefore of the emerging mist jet is accordingly perfectly controlled over a range PO. Furthermore, the gas G1, being a component on which the first low pressure mixture MLG1 is based, undergoes pressure reduction with a steep gradient, such that it accelerates and vectorizes a large proportion of the droplets GOUT along a vector axis AX (main axis of symmetry of the nozzle). In this jet, which may have a variable but controlled divergence, the gas G1 in the second mixture MLG2 therefore carries the droplets GOUT over the range PO. The range PO is of course associated with the particular geometry of the nozzle used and with the generating conditions. During pressure reduction in a nozzle of suitable geometry, the gas G1 originating from the first mixture MLG1 supplies work which accordingly provides, on the one hand, additional propulsion of the liquid L1, originally coarsely broken up, and on the other hand, atomization thereof into fine, uniform droplets. The emerging jet takes the form of a fast moving mist (50 to 150 m/s).

This concept exploits a simply shaped nozzle geometry comprising "large" orifices (up to a few mm in size) to implement a complex physical pressure reduction process within the diphasic flow which combines:

- pressure reduction with steep pressure gradients combined with vigorous transfer of a quantity both of movement (interfacial drag) and energy (interfacial heat and work), with the efficiency of these transfers being associated with the increase in interfacial area (surface area of liquid/gas exchange) as a result of atomization.
- controlled breaking up and acceleration of the liquid phase.

The particle size characteristics and range of the ejected second liquid/gas mixture MLG2 are controllable by said generating conditions such as the total inlet pressure in the emulsification chamber EMC or the nozzle(s) EJ and the mass flow rates of the liquid L1 and the gas G1. These generating conditions relating to nozzle flow are suited to nozzle operating points with a targeted particle size and range.

With a given nozzle geometry, the feed conditions (pressure of the first mixture MLG1 on inlet into the nozzle EJ, incoming flow rate of the liquid L1, incoming flow rate of the gas G1) are not haphazard. It is possible to demonstrate that, for a nozzle geometry, there is a single relationship f such that:

$$f(\dot{m}_l, \dot{m}_g, Pin)=0$$

where $\dot{m}_l$ is the mass flow rate (in kg/sec) of the liquid L1, $\dot{m}_g$ is the mass flow rate (in kg/sec) of the gas G1 and Pin is the absolute pressure of the mixture MLG1 (in bar) on inlet into the nozzle.

Notes:

1. In diphasic flow, the parameter used is the gas mass content TM (ratio of the gas mass flow rate and the total "liquid+gas" mass flow rate), rather than the gas mass flow rate.

$$TM = \frac{\dot{m}_g}{\dot{m}_g + \dot{m}_1}$$

2. It is then possible to define nozzle operating points which are therefore characterized by a triplet set $\{\dot{m}_l, TM, Pin\}$ which constitutes the flow generating conditions on inlet into the nozzle. From a practical standpoint, this relationship means that a haphazard choice of (liquid and gas) flow rates and of pressure is not possible. One of the variables (for example the gas flow rate) must therefore be "relaxed". Thus, when making an adjustment, a liquid flow rate $\dot{m}_l$ and a feed pressure Pin may be selected, but the gas flow rate $\dot{m}_g$ is then imposed.

In accordance with this scheme, outlet values must be taken into consideration as relevant parameters. The diphasic jet arising at the nozzle outlet EJ is characterized by:

1. Jet dynamics of the order of 50 to 150 m/sec at the nozzle outlet
2. A particle size (droplet size) of the order of 50 to 150 μm
3. A jet envelope (i.e. the boundary between the jet and the outside of the jet)

It is possible, on the basis of these three fundamentally significant characteristics, to deduce relevant parameters, for example for the purposes of fire fighting, such as:

- Range PO, the maximum distance beyond which the dynamic characteristics of the jet are no longer sufficient to be effective against a fire.
- Interfacial area density, i.e. the total surface developed by all the drops present in a unit volume.
- Protected space (jet coverage by volume)

Of course, the jet outlet conditions (jet dynamics, particle size and envelope) are entirely determined by the flow generating conditions, which are also directly associated with the nozzle geometry. For a given nozzle geometry, operating points may accordingly be mapped as a function of the generating and outlet conditions for each desired ejection application.

In the general context of fire fighting, and more particularly by means of water mists, there are two separate approaches: focused protection (the jet is directed straight onto the identified site at risk, for example a tank, an engine, etc.) and space protection, in which the jet is directed so as to protect the overall space without attempting accurately to hit the flame zone.

The diphasic mist jet nozzles according to the invention produce, apart a certain divergence tolerance, a highly dynamic and relatively directional jet. Accordingly, in space protection applications, where the intention is to protect an overall space without favoring any particular direction, it is necessary to use a set of a plurality of nozzles capable of covering all directions throughout the space. Various solutions are available for this purpose (non-exhaustive list):

providing the nozzles at different locations in the space and arranged in different directions (comb or "swirl" network arrangement):

combining a plurality of nozzles on a single stationary body (multi-head device);

providing a plurality of nozzles on a rotary body (rotary multi-nozzle body).

Apart from some results which are of great interest, the network arrangements and the multi-head device have the drawback of leaving some space zones unprotected, whereas the solution of a rotary body to which are attached a plurality of nozzles makes it possible to sweep an entire set of directions and to provide optimum coverage of the space to be protected.

Figure 2:
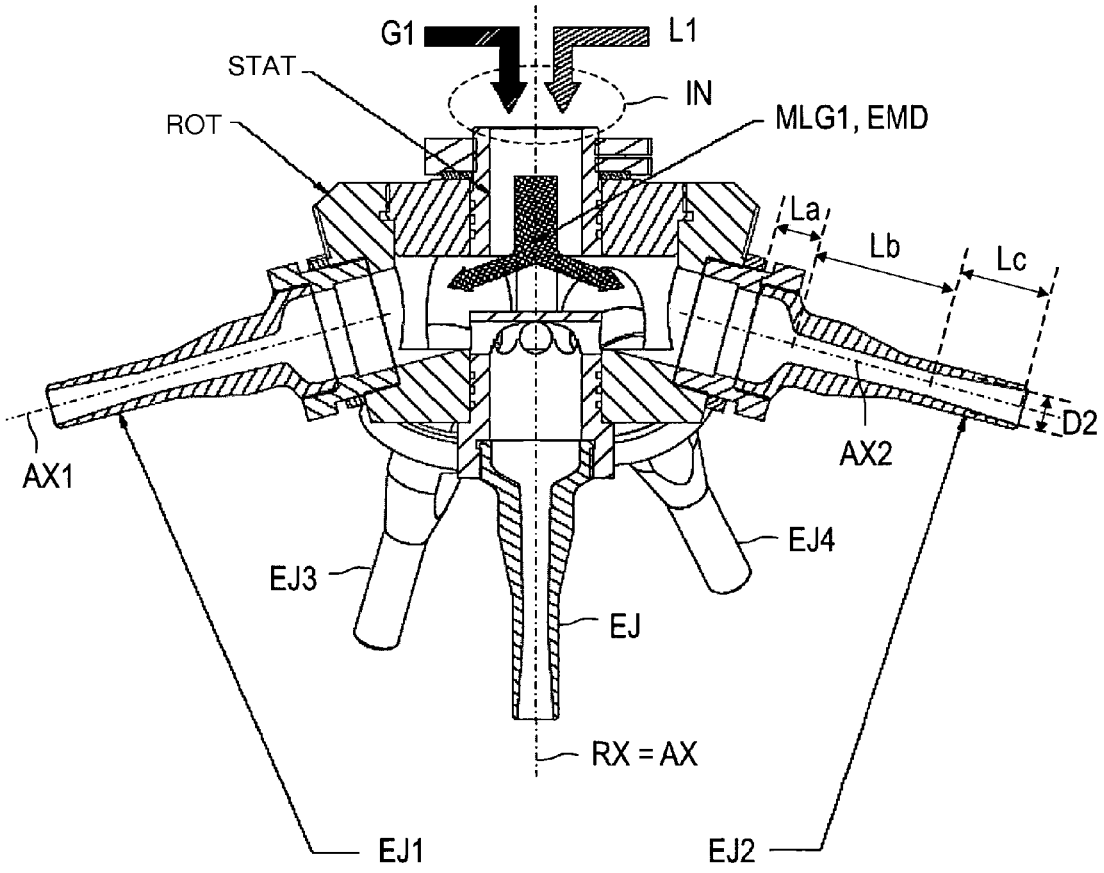
FIG. 2 shows a section of a rotary multi-nozzle device.

FIG. 2 shows a cross-section of such a device for ejecting a diphasic fluid MLG1 injected into a rotary multi-nozzle system. The system comprises a stator STAT which rotationally guides a rotor ROT, on which are arranged nozzles EJ, EJ1, EJ2 etc. according to FIG. 1. It should be noted that the gas G1 and the liquid L1 are directly injected up to the nozzle inlets through the single inlet IN of the stator STAT leading into an internal open space of the rotor ROT which simply acts as a distribution chamber EMD for the mixture MLG1. It should be noted that an efficient emulsification chamber, for example having perforated or subdividing elements, is no longer essential insofar as the mixture is admitted directly into the distribution chamber. If so required to control the quality of the admitted mixture, an emulsification chamber EMC, similar to that in FIG. 1, may be arranged upstream of the distribution chamber EMD. Accordingly, no perforated or subdividing element or which exhibits a risk of blockage is present in the distribution chamber EMD. The distribution chamber EMD embodied between the rotor ROT and the stator STAT is thus common to all the nozzles EJ, EJ1, EJ2 etc. which it supplies with water/gas mixture or any other liquid/gas mixture (possibly also containing more than two phases).

The nozzles EJ1, EJ2 etc. and their axes AX1, AX2 etc. arranged in offset or asymmetrical manner relative to the axis of rotation RX of the rotor ROT enable rotary propulsion by the reaction forces of the jets emerging from the nozzles. The axis AX of one nozzle EJ may be superposed on the axis of rotation RX of the rotor ROT, but makes no contribution to rotation of the rotor. This nozzle EJ may also be attached to the stator STAT to simplify construction of the complete device and avoid any rotation of the nozzle about its own axis. Accordingly, a plurality of ejection nozzles EJ1, EJ2, etc. provided with their vector axes AX1, AX2, etc. of separate jets are arranged on the walls of the distribution chamber EMD, in particular so as to achieve a mist coverage area or volume which extends at least over a defined range. Certain vector axes AX1, AX2, etc. of the ejection nozzles EJ1, EJ2, etc. may be arranged asymmetrically on the rotor ROT about a plane comprising the axis of rotation RX, and are in particular oriented in offset manner by an angle of between 0° and 90° beneath a plane perpendicular to the axis of rotation RX. One simple way of promoting jet distribution is for this angle to be different between at least two neighboring nozzles.

Thanks to the geometry of the nozzles, the outlet pressure reduction levels of ejection nozzles EJ1, EJ2, etc. and/or the separate directions of the vector axes AX1, AX2, etc. are thus suitable for producing a rotary action of the rotor ROT at a controlled speed of rotation. In particular, the vector axes AX1, AX2, etc. may also lack any intersection with the axis of rotation RX in order, by nozzle reaction forces, to generate on the rotor ROT a torque component lateral of the nozzle which brings about angular displacement of the rotor ROT about its axis RX.

It is, of course, possible to arrange ejection nozzles EJ1, EJ2, etc. having different geometries with an influence on the particle size and/or range of the second liquid/gas mixture MLG2 on the rotor ROT. In this manner, the mist obtained may have various properties of use to various operating modes (close and distant extinguishing, a plurality of controlled drop diameters).

In this device and just as for the nozzle of FIG. 1, the pressure of the liquid L1 and/or of the gas G1 at the injection inlet may be adjusted in accordance with the ratio of the inlet flow rates for the liquid L1 and the gas G1. Likewise, the device is designed with geometrically designed nozzles, such that the particle size and range characteristics of the second ejected liquid/gas mixture MLG2 are controllable by generating conditions such as the total inlet pressure into the distribution chamber EMD or the nozzle(s) EJ, EJ1, EJ2, etc. and the mass flow rates of the liquid L1 and the gas G1. Consequently, as for a nozzle, the rotary device satisfies generating conditions relating to nozzle flow which are appropriate for operating points of the device for one (or more) targeted particle size(s) and/or one (or more) targeted range(s). On the basis of this configuration, liquid flow rates L1 of the order of or less than 2 kg/s are made possible.

Finally, FIG. 2 shows an appropriate embodiment of the rotary multi-nozzle device which exhibits one of the ideal nozzle geometries according to the invention. This geometry has been stated in detail for nozzle EJ2 viewed in section at the level of its vector axis AX2 (axis of symmetry of the nozzle). Nozzle EJ2 is principally composed of three portions of length La, Lb, Lc along its vector axis AX2. The nozzle inlet consists of a first zone, of length La, which converges with a steep gradient, followed by a second zone, of length Lb, which converges with a shallow gradient, by a portion with the minimum cross-section, also known as the neck of the nozzle, and optionally by a third, divergent zone, of length Lc, which terminates in the nozzle outlet cross-section of dimension D2 (normally greater than 1 mm for extinguishing or cooling applications over a few tens of meters). The first zone with a steep gradient promotes rapid atomization of the flow, and the increase in exchange surface area arising from this atomization allows vigorous transfers of quantities of movement and energy between liquid and gas in the overall nozzle which thus simultaneously ensures atomization and acceleration of the liquid during pressure reduction. It is thanks to such a geometry and such dimensions that, after pressure reduction in the nozzle, the diphasic mixture may be ejected in the form of mist with a controlled particle size, range and volume as described by the invention.

Figure 3:
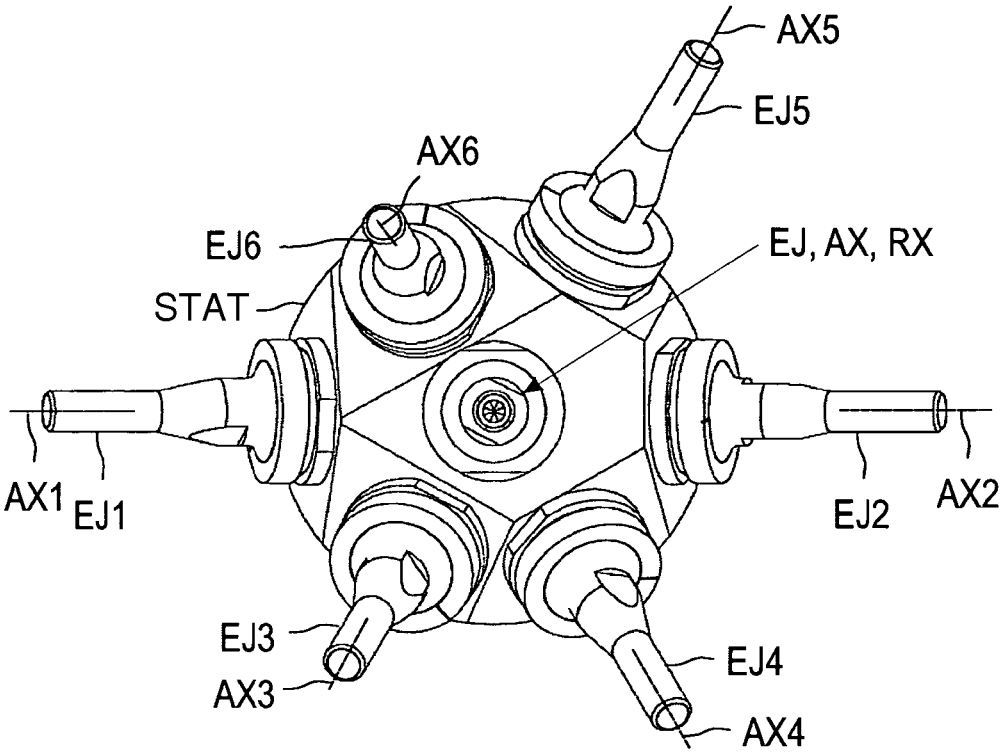
FIG. 3 shows a view from below of the rotary multi-nozzle device.
Figure 4:
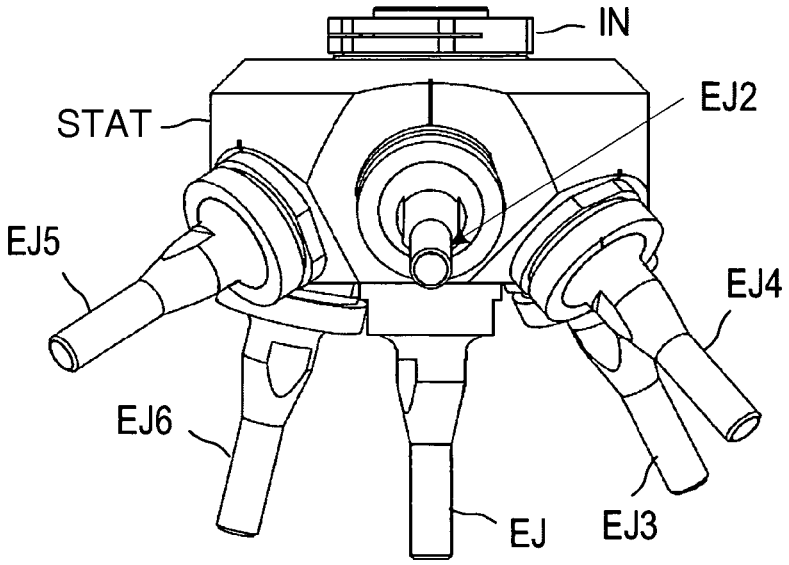
FIG. 4 shows a side view (from the right) of the rotary multi-nozzle device.

FIGS. 3 and 4 show a view from below and a side view (from the right) of a rotary multi-nozzle device according to FIG. 2. In particular, it should be noted that the arrangement of nozzles EJ1, EJ2, . . . , EJ6 relative to the axis of rotation RX of the rotor ROT (or relative to a plane comprising the axis of rotation RX) is asymmetrical when considering two nozzles having vector axes included in a single plane also comprising the axis of rotation RX of the rotor (for example nozzles EJ4 and EJ6 with their vector axes AX4 and AX6). The neighboring nozzles are also angularly offset relative to the axis of rotation RX of the rotor ROT. This arrangement not only promotes the controlled rotary effect of the rotor ROT, but also provides a jet sweep extending over spaces to be moistened.

It should be emphasized that this system provides an advantage of an environmental nature because it operates at low water flow rates in comparison with current devices for ejecting a diphasic water/gas mixture (slightly compressed gas). It therefore enables low water consumption furthermore combined with precisely controlled distribution of the water. This device could therefore also advantageously be used outside buildings for fire prevention in natural environments. The water could be drawn from any kind of source (in particular ground water). A moistening or even watering function is also possible over large areas while minimizing water consumption and without requiring elevated pressures at the device inlet. Other environments such as flammable industrial surfaces may also be protected from any suspicious heating or fire.

The present invention may potentially be adapted to other types of applications such as propellant feed/atomization for rocket engines, or for optimizing fuel injection for combustion engines.

It is also possible according to the invention to improve the device for ejecting a (liquid or gaseous) fuel to form a large flame (example of industrial application: burners in glass-making furnaces; example of military application: flame thrower).

It is also possible to use the device for propulsion of a vehicle comprising the nozzle as propulsion means, such as for the propulsion of a water vessel or aircraft (submarine, jet ski, airplane etc.).

It will accordingly readily be understood that the present invention extends well beyond an exhaustive list of possible applications or uses of the nozzle or more generally of the ejection device.

The invention claimed is:

1. A device for ejecting an at least diphasic mixture, comprising:

at least one injection inlet for introducing a liquid and a gas;

a distribution chamber for producing a first liquid/gas mixture communicating with said injection inlet;

an ejection nozzle communicating with said distribution chamber for ejecting the first liquid/gas mixture, said ejection nozzle having a nozzle outlet, and said ejection nozzle extending in a main direction defined by a vector axis and having a geometry formed, over a length thereof, with the nozzle inlet having a first converging access zone with a steep gradient having a steep gradient axial length along said vector axis followed by a second converging zone with a shallow gradient and a second converging zone axial length along the vector axis, said second converging zone leading to a minimum cross-section defining a neck at a given location along the vector axis, said minimum cross-section causing a pressure reduction within said ejection nozzle, allowing the first liquid/gas mixture originating from said distribution chamber to be converted, in a direction of flow, into a second liquid/gas mixture at said nozzle outlet; said outlet being a diverging zone having a diverging zone axial length along the vector axis, the steep gradient axial length being less than the diverging zone axial length, which is less than the second converging zone axial length, said vector being a main axis of said ejection nozzle, said nozzle inlet and said nozzle outlet being symmetric about said main axis of said ejection nozzle;

wherein an ejection range of the second liquid/gas mixture and a particle size of the liquid in droplet form is controllable as a function of a mass flow rate of the liquid and the gas and of an absolute pressure at said injection inlet.

2. The device according to claim 1, wherein an ejection jet of the second mixture is a diphasic mist jet primarily following the vector axis and wherein a particle size in the mist jet, a range and a volume spread outside the vector axis are controllable.

3. The device according to claim 2 , wherein a pressure at said injection inlet into said distribution chamber is relatively low and a mist jet velocity is relatively high.

4. The device according to claim 3, wherein the pressure at said injection inlet is less than 20 bar and the mist jet velocity lies above 50 m/s.

5. The device according to claim 1, wherein a gas injection inlet and a liquid injection inlet of said at least one injection inlet are at a common level ahead of said nozzle inlet.

6. The device according to claim 1, wherein said ejection nozzle is one of a plurality of ejection nozzles provided with separate vector axes and disposed on walls of said distribution chamber.

7. The device according to claim 6, wherein said ejection nozzles are disposed to achieve a mist coverage area or volume that extends at least over a defined range.

8. The device according to claim 6, wherein said distribution chamber is disposed between a stator and a rotor with an axis of rotation, and wherein said at least one ejection nozzle is disposed on said rotor.

9. The device according to claim 8, wherein at least one ejection nozzle is disposed on said stator.

10. The device according to claim 8, wherein certain vector axes of said ejection nozzles are arranged asymmetrically on said rotor relative to a plane comprising an axis of rotation.

11. The device according to claim 10, wherein the certain vector axes of said ejection nozzles are oriented with an offset by an angle of between 0° and 90° beneath a plane perpendicular to the axis of rotation.

12. The device according to claim 8, wherein the vector axes of said ejection nozzles do not intersect with the axis of rotation and an arrangement thereof is suitable for producing a rotation of said rotor at a controlled speed of rotation.

13. The device according to claim 6, wherein said ejection nozzles have mutually different geometries with an influence on a particle size and/or a range of the second liquid/gas mixture.

14. The device according to claim 1, wherein the liquid is water and the gas is compressed air.

15. A device for ejection an at least diaphasic mixture, comprising:

at least one injection inlet for introducing a liquid and a gas;

a distribution chamber for producing a first liquid/gas mixture communicating with said injection inlet;

an ejection nozzle communicating with said distribution chamber for ejecting the first liquid/gas mixture, said ejection nozzle having a nozzle inlet, a nozzle outlet, and said ejection nozzle extending in a main direction defined by a vector axis and having a geometry formed, over a length thereof, with the nozzle inlet having a first converging access zone with a steep gradient having a steep gradient axial length along said vector axis followed by a second converging zone with a shallow gradient and a second converging zone axial length along the vector axis, said second converging zone leading to a minimum cross-section defining a neck at a given location along the vector axis, and said minimum cross-section causing a pressure reduction of the gas within said ejection nozzle, allowing the first liquid/gas mixture originating from said distribution chamber to be converted, in a direction of flow, into a second liquid/gas mixture at said nozzle outlet, said outlet being a diverging zone having a diverging zone axial length along the vector axis, the steep gradient axial length being less than the diverging zone axial length, which is less than the second converging zone axial length, and wherein the gas accelerates and vectorizes a large proportion of the droplets along the vector axis;

wherein an ejection range of the second liquid gas mixture and a particle size of the liquid in droplet form is controllable as a function of a mass flow rate of the liquid and the gas and of an absolute pressure at said injection inlet.

16. The device according to claim 15, wherein said nozzle inlet and said nozzle outlet are symmetric about said vector axis of said ejection nozzle.

17. A method, comprising: providing the device according to claim 1, and ejecting a liquid/gas mixture through for extinguishing a fire, for fire prevention by moistening with low liquid consumption, or for material cooling using water as a primary liquid and optionally admixing an extinguishing agent, a moistening agent, or a cooling agent.

18. A method of surface-treating a material, which comprises:

providing the device according to claim 1; and injecting water as the liquid and optionally admixing a cleaning agent, and cleaning the material; or injecting liquid mainly containing a coloring agent and applying paint onto the material; or producing a second mixture containing a chemical solution which is liquid or partially solid with a small particle size, and abrasively treating the material.

19. A method, comprising: providing the device according to claim 1 and employing the device for propellant feed/atomization for a rocket engine or for optimized fuel injection for a combustion engine.

20. A fuel ejection method, comprising: providing the device according to claim 1, injecting fuel into the injection inlet and ejecting the fuel from the at least one ejection nozzle and combusting the fuel and forming a large flame.

21. A propulsion method, which comprises providing the device according to claim 1 and employing the ejection nozzle as a propulsion means for a vehicle.

* * * * *